US011841671B2

(12) United States Patent
Yuzawa

(10) Patent No.: US 11,841,671 B2
(45) Date of Patent: Dec. 12, 2023

(54) APPARATUS AND IMAGE FORMING APPARATUS HAVING COVER ATTACHED BY FIRST AND SECOND ENGAGEMENT PORTIONS

(71) Applicant: CANON KABUSHIKI KAISHA, Tokyo (JP)

(72) Inventor: Atsuyuki Yuzawa, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/873,229

(22) Filed: Jul. 26, 2022

(65) Prior Publication Data

US 2023/0035674 A1 Feb. 2, 2023

(30) Foreign Application Priority Data

Jul. 30, 2021 (JP) ..... 2021-126301

(51) Int. Cl.
*G03G 21/00* (2006.01)
*G03G 21/16* (2006.01)

(52) U.S. Cl.
CPC ... *G03G 21/1633* (2013.01); *G03G 2221/169* (2013.01); *G03G 2221/1687* (2013.01)

(58) Field of Classification Search
CPC ..... G03G 21/1633; G03G 2221/1687; G03G 2221/169; F16B 5/0012; F16B 5/0016; F16B 5/0036; F16B 5/008
USPC ..... 399/107
See application file for complete search history.

(56) References Cited

U.S. PATENT DOCUMENTS

| | | | | |
|---|---|---|---|---|
| 9,310,760 | B2 | 4/2016 | Ichikawa | |
| 2019/0286047 | A1* | 9/2019 | Ishimitsu | G03G 21/1647 |
| 2020/0257237 | A1* | 8/2020 | Hyodo | G03G 21/1633 |

FOREIGN PATENT DOCUMENTS

| | | | | |
|---|---|---|---|---|
| JP | 2008158082 | A | 7/2008 | |
| JP | 2010079224 | A | 4/2010 | |
| JP | 2011242511 | A * | 12/2011 | G03G 21/1633 |
| JP | 2017217859 | A | 12/2017 | |
| JP | 2019126949 | A * | 8/2019 | B41J 29/02 |

* cited by examiner

*Primary Examiner* — Robert B Beatty
(74) *Attorney, Agent, or Firm* — ROSSI, KIMMS & McDOWELL LLP

(57) ABSTRACT

An apparatus includes an apparatus body, an exterior cover configured to pivot around a pivot shaft extending in a first direction, and extend in the first direction and a second direction orthogonal to the first direction, a first engagement portion including a first engagement surface, and a second engagement portion, the second engagement portion including a facing surface facing the first engagement surface. When viewed in a third direction orthogonal to an exterior surface of the exterior cover, the first engagement surface and the facing surface at least partially overlap each other. The facing surface includes a second engagement surface and an inclined surface. When viewed in the third direction, a ridgeline formed by the second engagement surface and the inclined surface extends further away from the pivot shaft in the second direction as the ridgeline extends more downstream in the first direction.

20 Claims, 12 Drawing Sheets

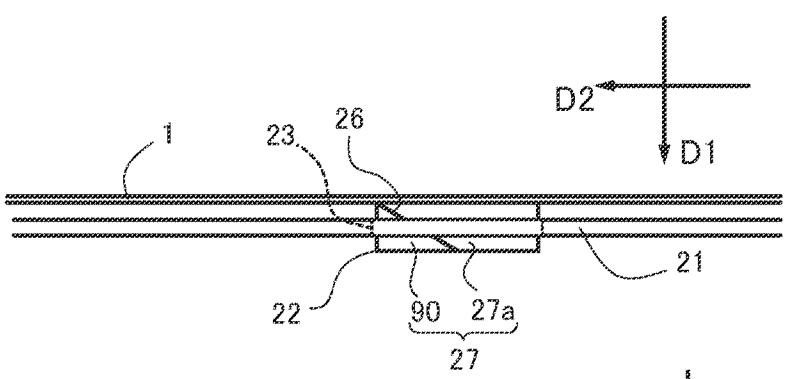
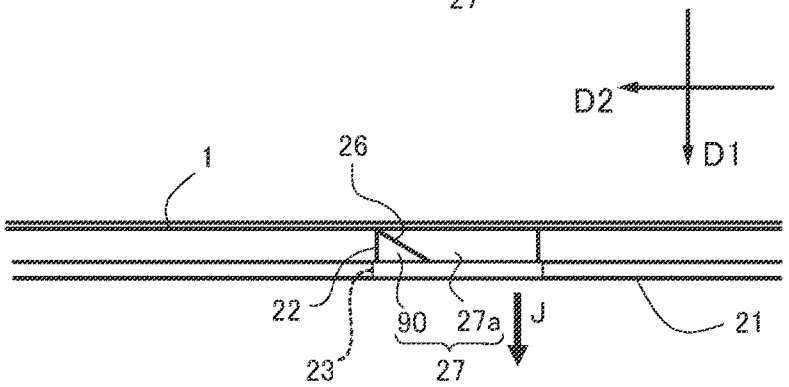
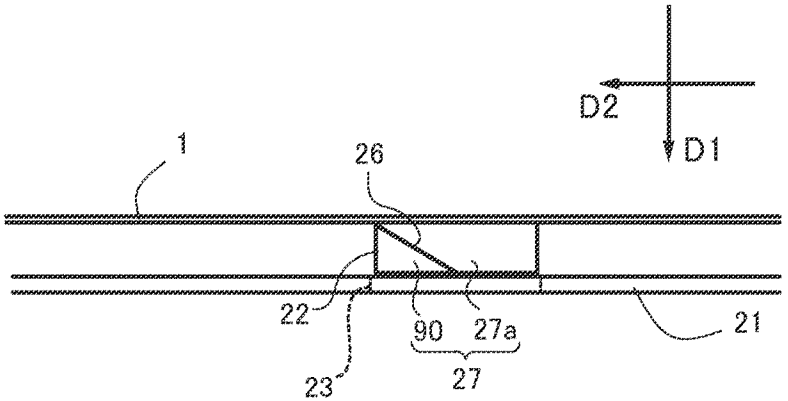
FIG.12A
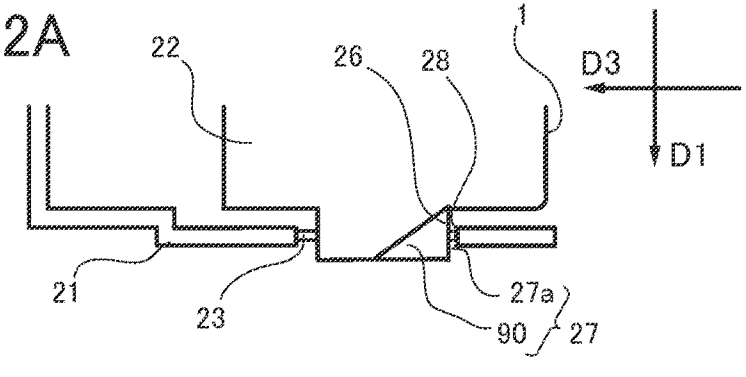
FIG.12B
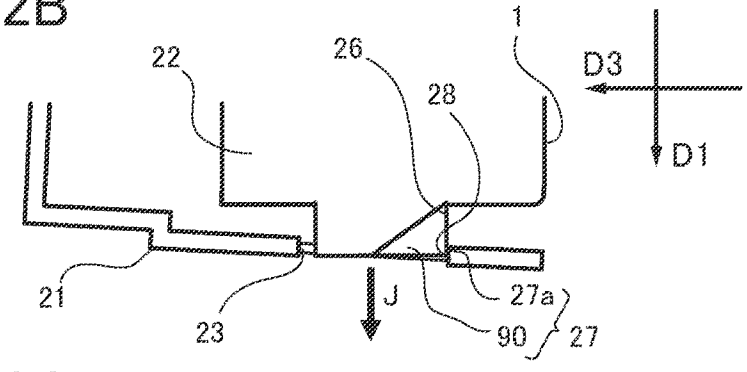
FIG.12C
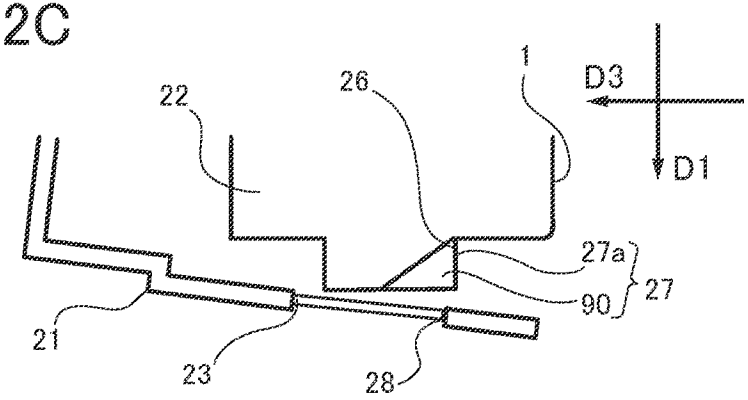

APPARATUS AND IMAGE FORMING APPARATUS HAVING COVER ATTACHED BY FIRST AND SECOND ENGAGEMENT PORTIONS

BACKGROUND OF THE INVENTION

Field of the Invention

This disclose relates to an apparatus which has a pivotable exterior cover, and an image forming apparatus.

Description of the Related Art

An image forming apparatus including an exterior cover which is attached to an apparatus body frame by a screw and the like is suggested by Japanese Patent Laid-Open No. 2008-158082. The exterior cover is detachably attached to the apparatus body frame.

Recently, there is a demand for the improvement in the workability at the time of detaching the exterior cover.

SUMMARY OF THE INVENTION

According to a first aspect of the present invention, an apparatus includes an apparatus body, an exterior cover configured to be pivotably attached to the apparatus body, the exterior cover being configured to pivot around a pivot shaft extending in a first direction, and configured to extend in the first direction and a second direction orthogonal to the first direction, a first engagement portion disposed in the apparatus body, the first engagement portion including a first engagement surface configured to extend in the first direction and the second direction, and a second engagement portion disposed in the exterior cover and configured to engage with the first engagement portion and release engagement with the first engagement portion by being moved in the first direction, the second engagement portion including a facing surface facing the first engagement surface in a state engaging with the first engagement portion. When viewed in a third direction vertical to an exterior surface of the exterior cover, the first engagement surface and the facing surface at least partially overlap each other in a state where the first engagement portion and the second engagement portion engage with each other. The facing surface includes a second engagement surface and an inclined surface, the second engagement surface being configured to engage with the first engagement surface, the inclined surface being disposed farther than the second engagement surface with respect to the pivot shaft in the second direction, the inclined surface extending so as to be inclined with respect to the second engagement surface. When viewed in the third direction, a ridgeline formed by the second engagement surface and the inclined surface extends further away from the pivot shaft in the second direction as the ridgeline extends more downstream in the first direction.

According to a second aspect of the present invention, an image forming apparatus includes an apparatus body, an exterior cover configured to be pivotably attached to the apparatus body, the exterior cover being configured to pivot around a pivot shaft extending in a first direction, and configured to extend in the first direction and a second direction orthogonal to the first direction, a first engagement portion disposed in the apparatus body, the first engagement portion including a first engagement surface configured to extend in the first direction and the second direction, and a second engagement portion disposed in the exterior cover and configured to engage with the first engagement portion and release engagement with the first engagement portion by being moved in the first direction, the second engagement portion including a facing surface facing the first engagement surface in a state engaging with the first engagement portion. When viewed in a third direction vertical to an exterior surface of the exterior cover, the first engagement surface and the facing surface at least partially overlap each other in a state where the first engagement portion and the second engagement portion engage with each other. The facing surface includes a second engagement surface and an inclined surface, the second engagement surface being configured to engage with the first engagement surface, the inclined surface being disposed farther than the second engagement surface with respect to the pivot shaft, the inclined surface extending so as to be inclined with respect to the second engagement surface. When viewed in the third direction, a ridgeline formed by the second engagement surface and the inclined surface extends closer to the pivot shaft in the second direction as the ridgeline extends more downstream in the first direction.

According to a third aspect of the present invention, an apparatus includes an apparatus body, an exterior cover configured to be pivotably attached to the apparatus body, the exterior cover being configured to pivot around a pivot shaft extending in a first direction, and configured to extend in the first direction and a second direction orthogonal to the first direction, a first engagement portion disposed in the apparatus body, the first engagement portion including a first engagement surface configured to extend in the first direction and the second direction, and a second engagement portion disposed in the exterior cover, the second engagement portion including a facing surface facing the first engagement surface in a state where the second engagement portion engages with the first engagement portion. When viewed in a third direction vertical to an exterior surface of the exterior cover, the first engagement surface and the facing surface at least partially overlap each other in the state where the first engagement portion and the second engagement portion engage with each other. The facing surface includes a second engagement surface and an inclined surface, the second engagement surface being configured to engage with the first engagement surface, the inclined surface being disposed farther than the second engagement surface with respect to the pivot shaft, the inclined surface extending so as to be inclined with respect to the second engagement surface. When the exterior cover is pivoted in a direction away from the apparatus body around the pivot shaft, a ridgeline formed by the second engagement surface and the inclined surface is sliding contact with the first engagement surface, and the second engagement portion moves in the first direction so as to release engagement between the first engagement portion and the second engagement portion.

According to a fourth aspect of the present invention, an image forming apparatus includes an apparatus body, an exterior cover configured to be pivotably attached to the apparatus body, the exterior cover being configured to pivot around a pivot shaft extending in a first direction, and configured to extend in the first direction and a second direction orthogonal to the first direction, a first engagement portion disposed in the apparatus body, the first engagement portion including a first engagement surface configured to extend in the first direction and the second direction, and a second engagement portion disposed in the exterior cover, the second engagement portion including a facing surface facing the first engagement surface in a state where the second engagement portion engages with the first engagement portion. When viewed in a third direction vertical to an exterior surface of the exterior cover, the first engagement surface and the facing surface at least partially overlap each other in the state where the first engagement portion and the second engagement portion engage with each other. The facing surface includes a second engagement surface and an inclined surface, the second engagement surface being configured to engage with the first engagement surface, the inclined surface being disposed farther than the second engagement surface with respect to the pivot shaft, the inclined surface extending so as to be inclined with respect to the second engagement surface. When the exterior cover is pivoted in a direction away from the apparatus body around the pivot shaft, a ridgeline formed by the second engagement surface and the inclined surface is sliding contact with the first engagement surface, and the second engagement portion moves in the first direction so as to release engagement between the first engagement portion and the second engagement portion.

Further features of the present invention will become apparent from the following description of exemplary embodiments with reference to the attached drawings.

BRIEF DESCRIPTION OF THE DRAWINGS

FIG. 12A shows a diagram the frame body and the side surface cover viewed from a plus side toward a minus side in the second direction and shows a diagram viewed from a minus side toward a plus side in the third direction.

FIG. 12B shows a diagram the frame body and the side surface cover viewed from a plus side toward a minus side in the second direction and shows a diagram viewed from a minus side toward a plus side in the third direction.

FIG. 12C shows a diagram the frame body and the side surface cover viewed from a plus side toward a minus side in the second direction and shows a diagram viewed from a minus side toward a plus side in the third direction.

DESCRIPTION OF THE EMBODIMENTS

First Embodiment

General Arrangement

Firstly, a first embodiment of this disclosure will be described. To be noted, in the following, a sheet includes, other than standard paper, special paper such as coated paper, a recording material including a specially shaped sheet such as an envelope and an index sheet, a plastic film for an overhead projector, and a cloth, and a manuscript is also an example of the sheet. To be noted, the manuscript that is the example of the sheet can be a blank sheet of paper or a sheet on which the image is formed on one side or both sides of surfaces.

In the following descriptions, a first direction D1 indicates the vertical direction perpendicularly intersecting with the horizontal surface. A direction intersecting with the first direction D1 and parallel to a rotational axis direction (main scanning direction) of a photosensitive drum 41, described later, is referred to as a third direction D3. A direction intersecting with the first and the third directions D1 and D3 is referred to as a second direction D2. Preferably, the first, second, and third directions D1, D2, and D3 perpendicularly intersect with each other. Further, for convenience, a plus side and a minus side in the first direction D1 are respectively referred to as a lower side and an upper side, plus side and a minus side in the third direction D3 are respectively referred to as a right side and a left side, and a plus side and a minus side in the second direction D2 are respectively referred to as a back side and a front side.

Figure 1A:
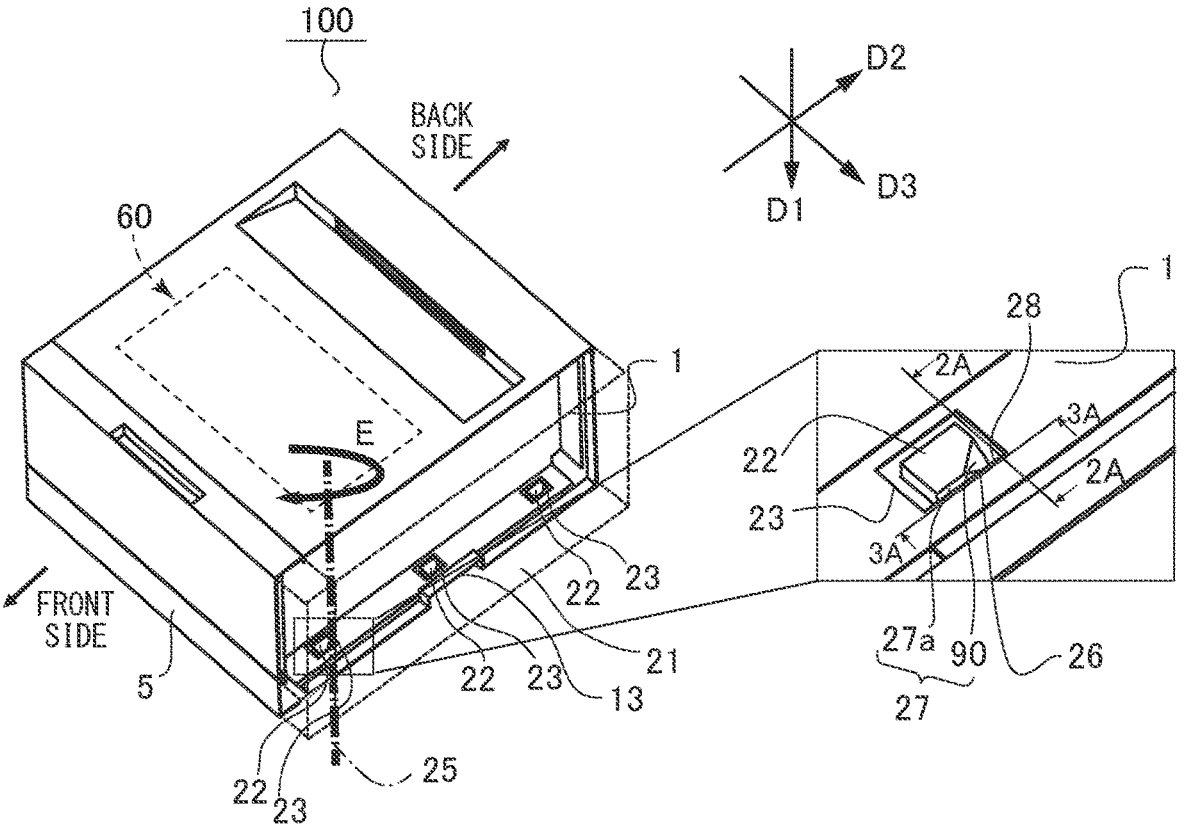
FIG. 1A is an overall schematic diagram and a partially enlarged view showing a printer relating to a first embodiment.
Figure 1B:
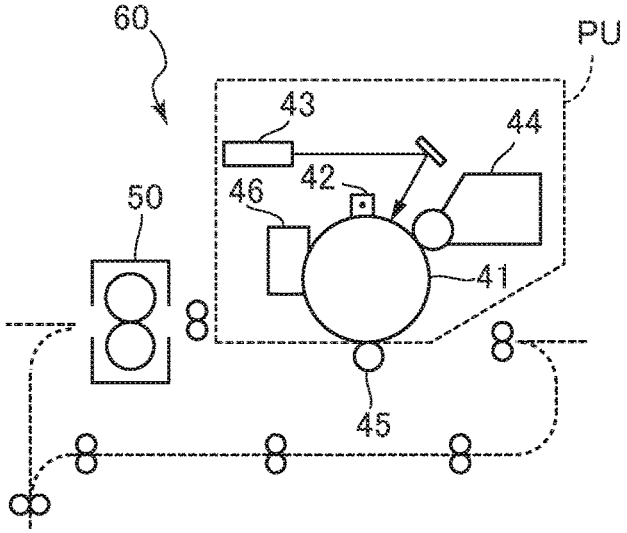
FIG. 1B is a schematic diagram showing an image forming engine.

A printer 100, serving as an image forming apparatus relating to the first embodiment, is a laser beam printer of an electrophotographic system. The printer 100, as shown in FIGS. 1A and 1B, includes an image forming engine 60 inside. The image forming engine 60 includes an image forming unit PU of the electrophotographic system, and a fixing unit 50. The image forming unit PU, serving as an image forming unit, is housed in a frame body 1, serving as an apparatus body of the printer 100. When the start of an image forming operation is instructed, the photosensitive drum 41, serving as an image bearing member, rotates, and a surface of the drum is uniformly charged by a charge unit 42. The photosensitive drum 41 is rotatable and capable of bearing a toner image. Then, an exposing unit 43 modulates and outputs a laser beam based on image data transmitted from an external computer and the like, and scans the surface of the photosensitive drum 41 so as to form an electrostatic latent image. This electrostatic latent image becomes the toner image by being visualized (developed) with a toner supplied from a developing unit 44.

In parallel with the image forming operation as described above, a sheet feed operation of feeding the sheet loaded on a cassette 5 or a manual feed tray toward the image forming engine 60 is executed. To be noted, the cassette 5 is detachable from the front side of the printer 100, and is inserted toward the back side of the printer 100. The sheet that has been fed is conveyed in the timing synchronizing with the progress of the image forming operation by the image forming unit PU. Then, the toner image borne on the photosensitive drum 41 is transferred onto the sheet by a transfer roller 45. The toner remained on the photosensitive drum 41 after the transfer of the toner image is collected by a cleaning unit 46. The sheet onto which an unfixed toner image has been transferred is delivered to the fixing unit 50, and heated and pressed by being nipped by a roller pair. The sheet on which the image is fixed by melting and bonding the toner is discharged by a sheet discharge roller pair and the like.

A side surface cover 21, serving as an exterior cover, is attached to the frame body 1 of the printer 100, and constitutes a part of an exterior of the printer 100. A plurality (three in this embodiment) of hole portions 23 are formed in the frame body 1, and, corresponding to the plurality of hole portions 23*a*, a plurality (three in this embodiment) of projection portions 22 are disposed in the side surface cover 21. The side surface cover 21 is fixed to the frame body 1 by a screw, not shown, in a state where the three projection portions 22 are engaged with the hole portions 23 in the frame body 1. Thereby, the side surface cover 21 is attached to the frame body 1. To be noted, in a state where the side surface cover 21 is attached to the frame body 1, the side surface cover 21 is pivotably supported with respect to the frame body 1 around a pivot shaft 25.

Comparative Example

Figure 9A:
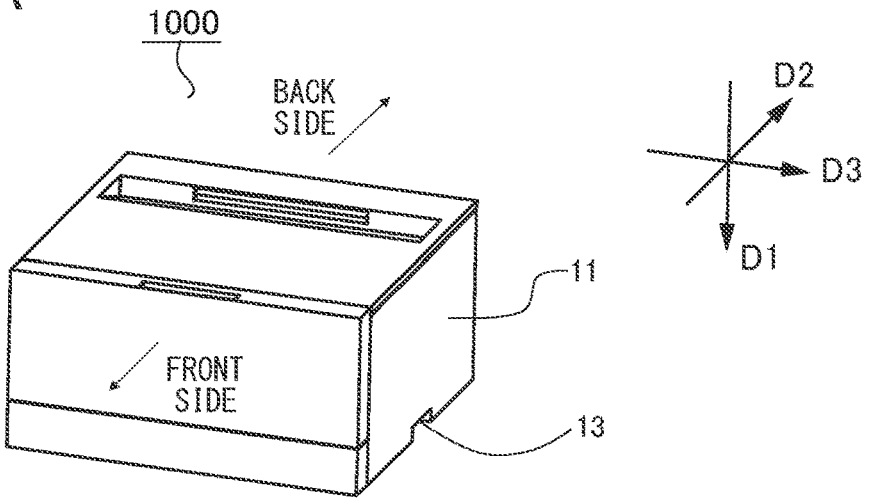
FIG. 9A is a perspective view showing a printer relating to a comparative example.
Figure 9B:
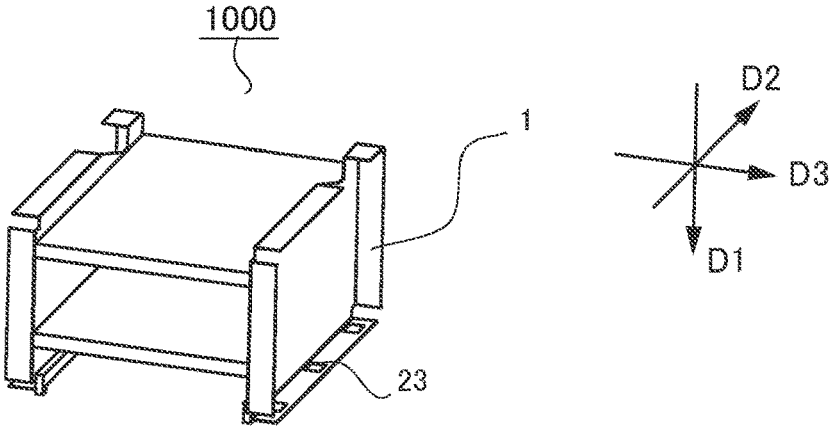
FIG. 9B is a perspective view showing a frame body.
Figure 9C:
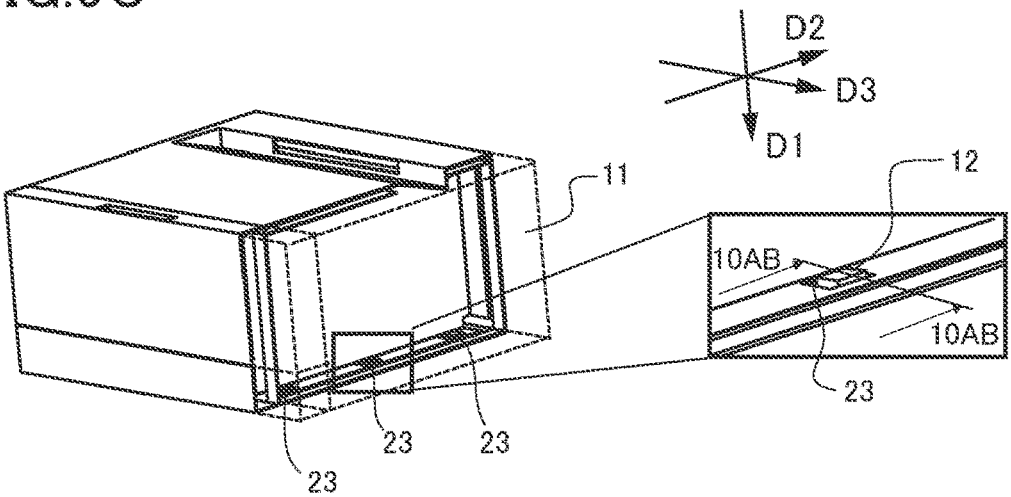
FIG. 9C is a perspective view and a partially enlarged view showing a projection portion and a hole portion.

Now, with reference to FIGS. 9A to 11, a printer 1000 relating to a comparative example will be described. As shown in FIGS. 9A to 9C, the printer 1000 includes the frame body 1 and a side surface cover 11 attached to the frame body 1. Similar to FIG. 1A, three hole portions 23 are formed in the frame body 1, and, corresponding to the hole portions 23, three projection portions 12 are disposed in the side surface cover 11. The side surface cover 11 is fixed such that the three projection portions 12 are engaged with the three hole portions 23. Thereby, the side surface cover 11 is attached to the frame body 1.

Figure 10A:
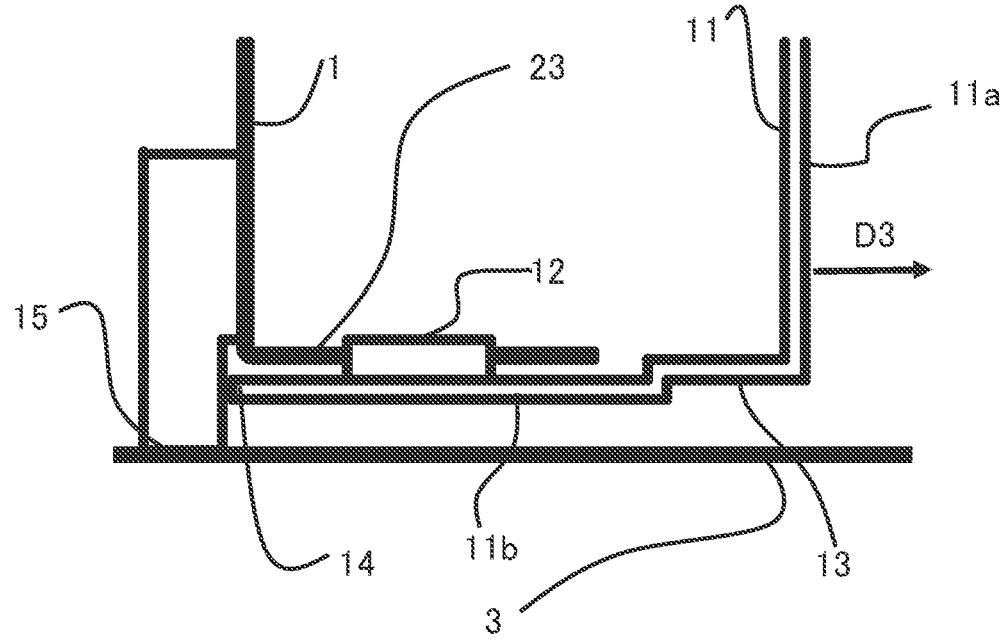
FIG. 10A is a diagram in which a cross-section taken along 10AB-10AB in FIG. 9C is viewed from a front side.
Figure 10B:
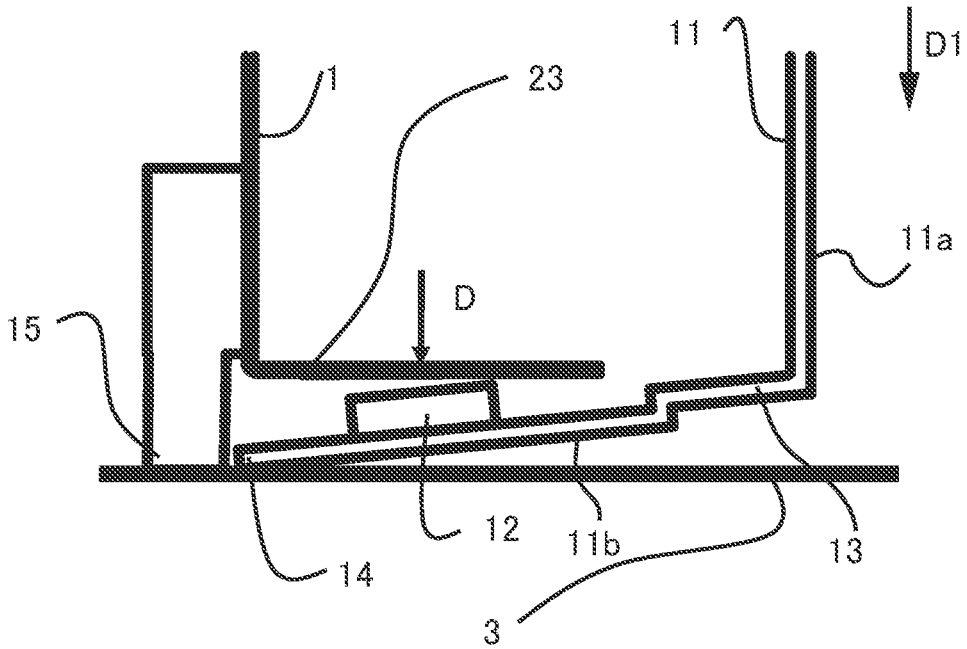
FIG. 10B is a diagram in which the cross-section taken along 10AB-10AB in FIG. 9C is viewed from the front side in a state where a bottom portion of a side surface cover is bent downward.
Figure 11:
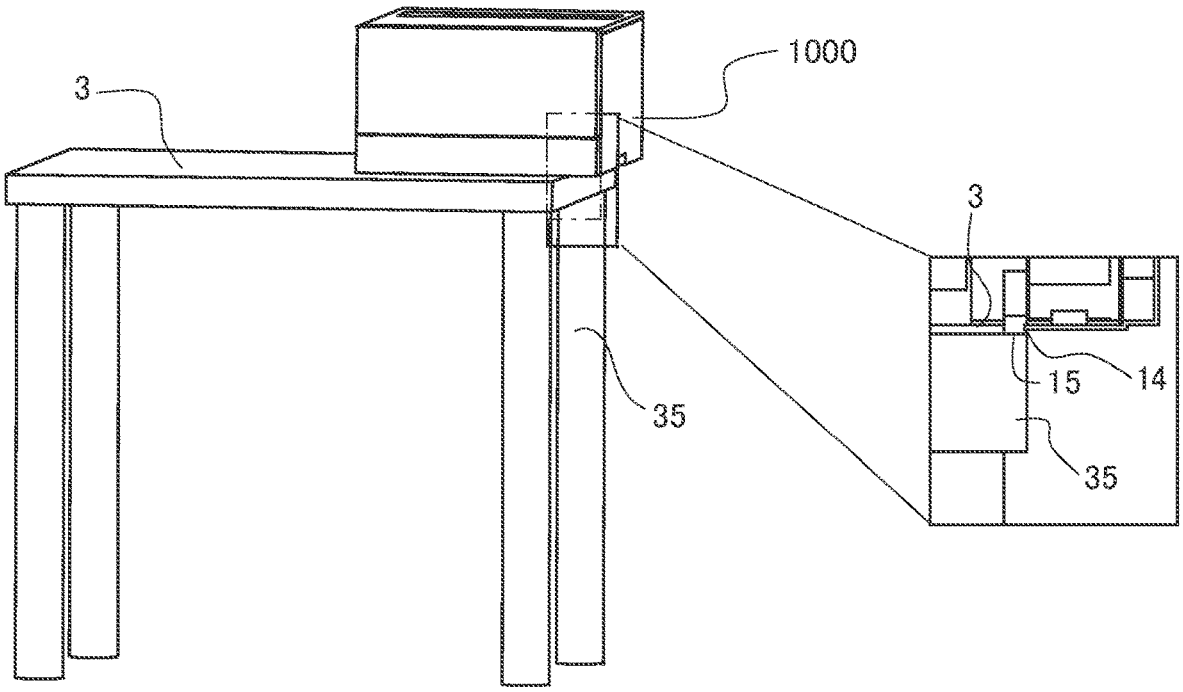
FIG. 11 is a perspective view and a partially enlarged view showing a printer installed at an edge of an installation stand.

A handle 13 in a recessed shape capable of being grasped is disposed in the lower side of the frame body 1, and a user is able to carry the printer 1000 by grasping the handle 13. FIG. 10A is a diagram in which a cross-section taken along 10AB-10AB in FIG. 9C is viewed from the front side, and FIG. 10B is a diagram in which the cross-section taken along 10AB-10AB in FIG. 9C is viewed from the front side in a state where a bottom portion of the side surface cover 11 is bent downward. As shown in FIG. 10A, when the handle 13 is grasped by the user, a force in the third direction D3 is applied to the side surface cover 11.

As described above, since it is considered that the force is applied to the side surface cover 11 in the third direction D3, the projection portions 12 are inserted into the hole portions 23 from below. That is, the third direction D3 is a direction parallel to the rotational axis direction of the photosensitive drum 41, and the projection portions 12 engage with the hole portions 23 in the first direction D1 which is the vertical direction perpendicularly intersecting with the horizontal direction. In other words, the projection portions 12 are inserted into the hole portions 23 so as to project from below to above. Thereby, since, for example, even if the side surface cover 11 is pulled in the third direction D3, the projection portions 12 are caught by the hole portions 23, the side surface cover 11 is not detached.

So as to remove the side surface cover 11 from the frame body 1, as shown in FIG. 10B, first, the projection portion 12 of the side surface cover 11 is moved in an arrow D direction, that is, the first direction D1. Then, in a state where the engagement between the projection portion 12 and the hole portion 23 is released, the side surface cover 11 is detached from the frame body 1 by pulling the side surface cover 11 in the third direction D3.

The side surface cover 11 includes a wall portion 11*a* extending in the first and second directions D1 and D2 and a bottom portion 11*b* in which the projection portions 12 are disposed, and the side surface cover 11 is formed, for example, by a resin material having elasticity. Then, when, for example, a serviceman pulls an edge portion 14 of the bottom portion 11*b* in the arrow D direction, the bottom portion 11*b* bends downward with respect to the wall portion 11*a*, and the projection portion 12 is detached from the hole portion 23.

An installation portion 15 installed on an installation surface 3 is disposed in the frame body 1 of the printer 1000, and the edge portion 14 is disposed in adjacent to the installation portion 15. Since a gap between the installation surface 3 and the bottom portion 11*b* of the side surface cover 11 is small, it is difficult for the serviceman to access the edge portion 14.

Therefore, the serviceman installed the printer 1000 at an edge of the installation surface 3 of a tall installation stand 35 such that the edge portion 14 protrudes from the edge of the installation surface 3, and carried out a detachment work of the side surface cover 11. However, since, in the detachment work as described above, it was necessary to carry out the work while holding the printer 1000 so as not to drop the printer 1000 from the installation stand 35, there was a problem in workability. Therefore, in this embodiment, as shown in FIG. 1A, an inclined surface 90 is disposed in the projection portion 22 disposed in the side surface cover 21.

Detail Configuration of Projection Portion

Figure 2:
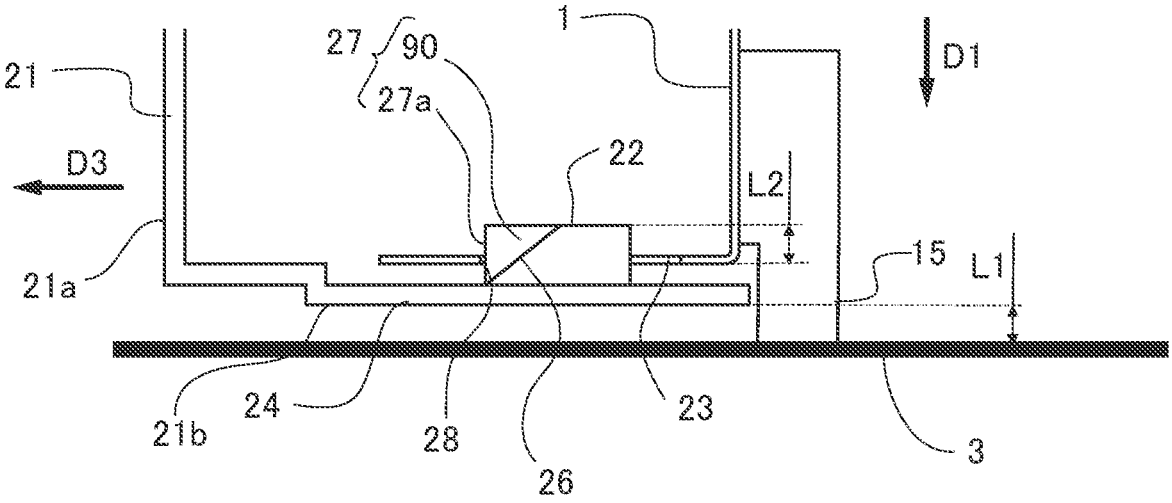
FIG. 2 is a diagram in which a cross-section taken along the line 2A-2A in FIG. 1A is viewed from a back side.
Figure 3:
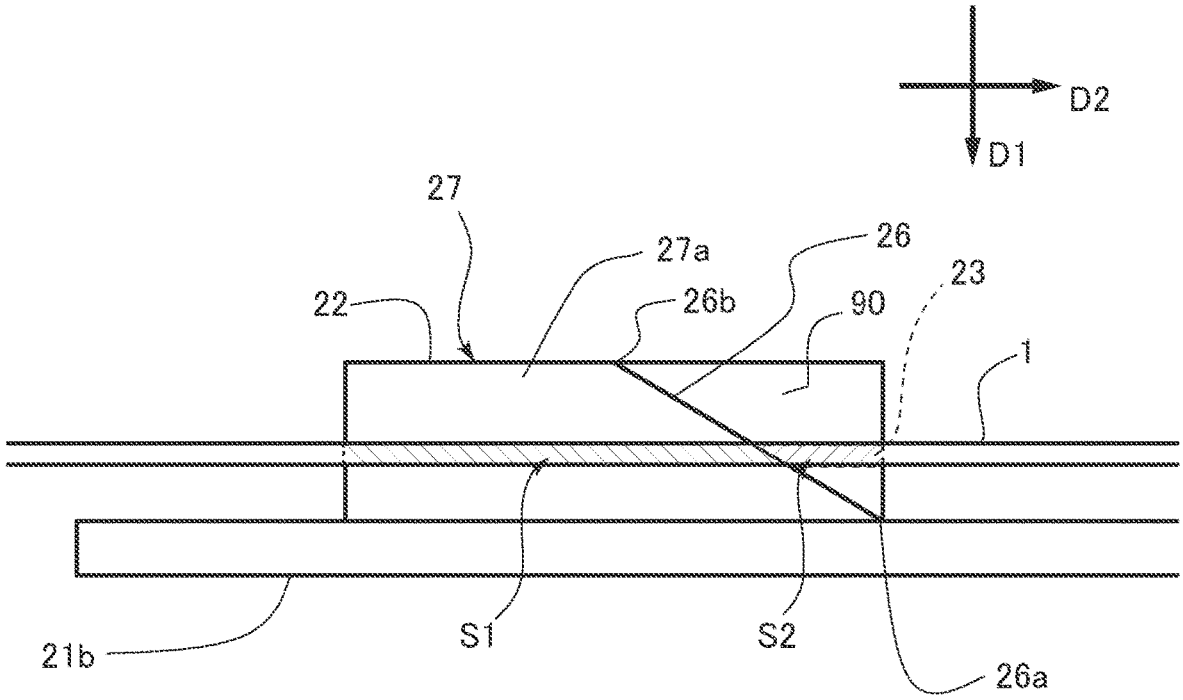
FIG. 3 is a diagram in which a cross-section taken along the line 3A-3A in FIG. 1A is viewed from a right side.

Next, a detail configuration of the projection portion 22 relating to this embodiment will be described. FIG. 2 is a diagram in which a cross-section taken along 2A-2A in FIG. 1A is viewed from the back side, and FIG. 3 is a diagram in which a cross-section taken along 3A-3A in FIG. 1A is viewed from the right side. To be noted, while the projection portions 22 and the hole portions 23 each are disposed three, these are the same in configurations, so that only the one projection portion 22 and hole portion 23 will be described, and descriptions of the other projection portions 22 and hole portions 23 will be omitted herein.

As shown in FIGS. 1A to 3, the side surface cover 21 includes a wall portion 21*a* extending in the first direction D1, which is the vertical direction, and a bottom portion 21*b* in which the projection portion 22 is disposed, and is formed by, for example, a resin material. The bottom portion 21*b* is elastically deformable in the first direction D1 with respect to the wall portion 21*a*.

The hole portion 23, serving as a first engagement portion, includes a rectangular through hole penetrating in the first direction D1, and the projection portion 22 serving as a second engagement portion, is capable of engaging with the hole portion 23 by being inserted into the hole portion 23 from below. In other words, the projection portion 22 extends in the first direction D1, and is capable of being inserted into the hole portion 23 so as to project upward from below with respect to the hole portion 23.

As shown in FIG. 2, in this embodiment, in a state where the installation portion 15 is installed on the installation surface 3, a distance between a bottom surface 24 of the bottom portion 21*b* of the side surface cover 21 and the installation surface 3 is set at a distance L1. Further, in a state where the projection portion 22 engages with the hole portion 23, the height of a part of the projection portion 22 protruding upward from the hole portion 23 is referred to as a height L2. Then, a relationship between the distance L1 and the height L2 are set such that L1 becomes larger than L2. Thereby, even in a state where the printer 100 is installed on the installation surface 3, it is possible to detach the projection portion 22 from the hole portion 23 by elastically deforming the bottom portion 21*b* downward.

The hole portion 23 and the projection portion 22 respectively include a first engagement surface 28 and a facing surface 27 facing each other in the horizontal direction. In particular, the facing surface 27 of the projection portion 22 faces the first engagement surface 28 of the hole portion 23 in the third direction D3 shown in FIG. 2. The third direction D3 is a direction in which a force is applied to the side surface cover 21 when, for example, a user grasps the handle 13, serving as a grasping portion, and, in this embodiment, is a direction from the left of the printer 100 toward the right. Further, the first engagement surface 28 and the facing surface 27 overlap each other in the first direction D1 in a state where the projection portion 22 and the hole portion 23 engage with each other. In other words, when viewed in the third direction D3 perpendicular to the wall portion 11*a* which is an exterior surface of the side surface cover 21, the first engagement surface 28 and the facing surface 27 at least partially overlap each other in the state where the projection portion 22 and the hole portion 23 engage with each other.

The projection portion 22 includes an approximately rectangular parallelepiped shape in which one of corner portions is chamfered by the inclined surface 90. The facing surface 27 includes a second engagement surface 27*a* and the inclined surface 90. The second engagement surface 27*a* extends parallel to the second and first directions D2 and D1. To be noted, the first engagement surface 28 of the hole portion 23 also extends parallel to the second and first directions D2 and D1. That is, the first and second engagement surfaces 28 and 27*a* each are surfaces extending parallel to the second and first directions D2 and D1 and orthogonal to the third direction D3.

The inclined surface 90 extends so as to be inclined in the first, second, and third directions D1, D2, and D3, and extends downstream in the first direction D1, that is, downward toward the downstream in the second and third directions D2 and D3. In other words, the inclined surface 90 extends so as to be inclined with respect to the second engagement surface 27*a*. To be noted, a downstream direction in the second direction D2 means a direction toward the plus side in the second direction D2, and, in this embodiment, means a direction toward the back side. Further, a downstream direction in the third direction D3 means a direction toward the plus side in the third direction D3, and, in this embodiment, means a direction toward the right side. Further, a ridgeline 26 is formed on a boundary between the second engagement surface 27*a* and the inclined surface 90. The ridgeline 26 is inclined downstream in the first direction D1 toward downstream in the second direction D2. In other words, when viewed in the third direction D3, the ridgeline 26 extends further away from the pivot shaft 25 in the second direction D2 as the ridgeline 26 extends more downstream in the first direction D1.

The inclined surface 90 is disposed in a position farther than the second engagement surface 27*a* with respect to the pivot shaft 25. That is, in the second direction D2, the second engagement surface 27*a* is disposed downstream of the pivot shaft 25, and the inclined surface 90 is disposed downstream of the second engagement surface 27*a*.

Since the facing surface 27 of the projection portion 22 is formed as described above, if, for example, the user tries to move the side surface cover 21 in the third direction D3 by grasping the handle 13, the second engagement surface 27*a* of the projection portion 22 abuts onto the first engagement surface 28 of the hole portion 23. Therefore, it is possible to prevent the accidental detachment of the side surface cover 21 from the frame body 1. To be noted, at least one of the projection portions 22 and at least one of the hole portions 23 are disposed in adjacent to the handle 13 in the third direction D3 in the state where the projection portions 22 and the hole portions 23 engage with each other.

Detachment of Side Surface Cover

Figures 4A, 4B, 4C:
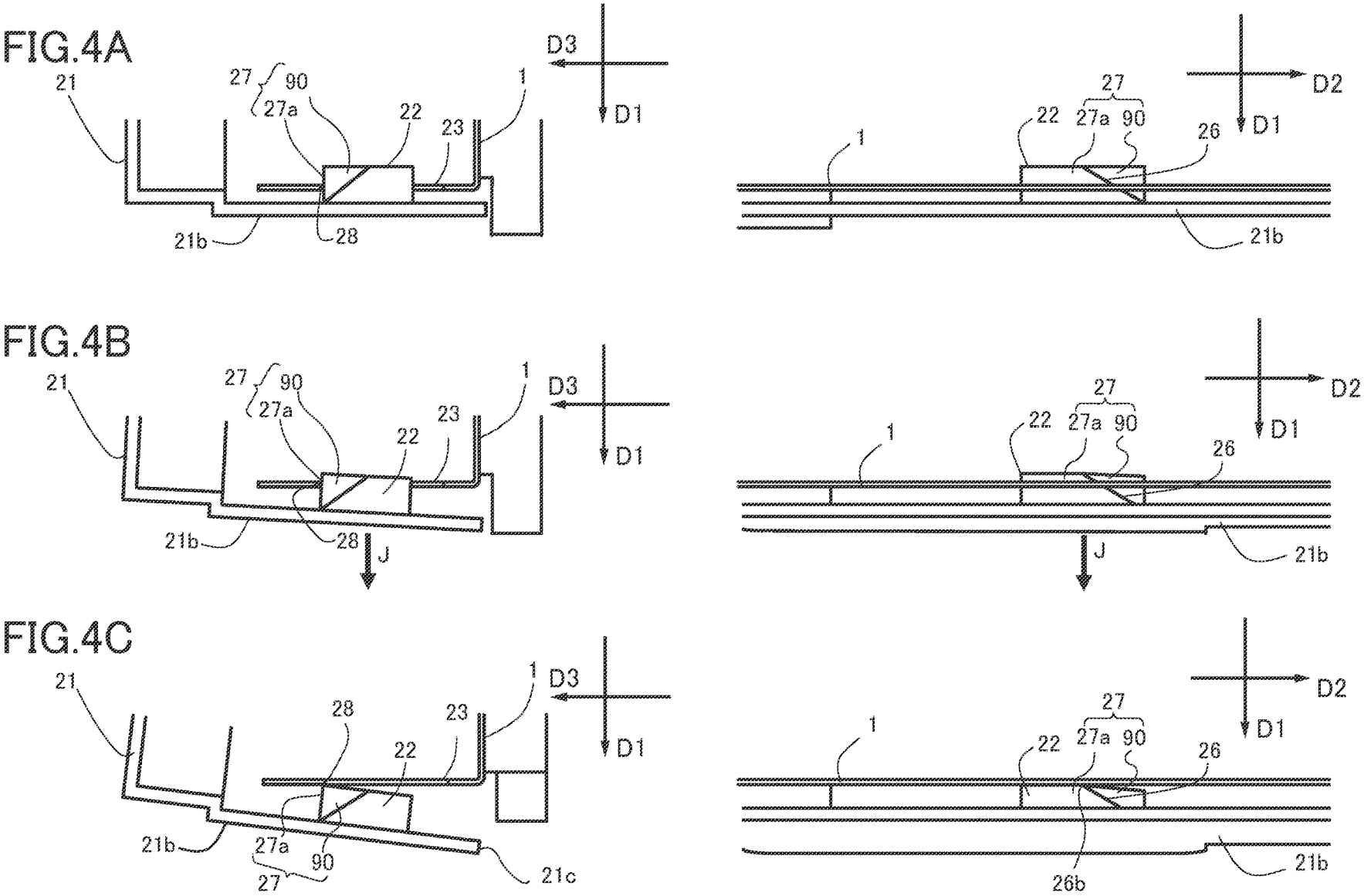
FIG. 4A is a cross-sectional view showing the cross-sections taken along the lines 2A-2A and 3A-3A in FIG. 1A in a state where a force is not applied to a side surface cover.
FIG. 4B is a cross-sectional view showing the cross-sections taken along the lines 2A-2A and 3A-3A in FIG. 1A when the side surface cover has been pivoted in an arrow E direction around a pivot shaft.
FIG. 4C is a cross-sectional view showing the cross-sections taken along the lines 2A-2A and 3A-3A in FIG. 1A when the side surface cover has been pivoted further in the arrow E direction.

Next, a method of detaching the side surface cover 21 from the frame body 1 will be described in detail. FIG. 4A is a cross-sectional view showing cross-sections taken along 2A-2A and 3A-3A in FIG. 1A in a state where a force is not applied to the side surface cover 21. FIG. 4B is a cross-sectional view showing cross-sections taken along 2A-2A and 3A-3A in FIG. 1A when the side surface cover 21 is pivoted in an arrow E direction around the pivot shaft 25 as the center. FIG. 4C is a cross-sectional view showing cross-sections taken along 2A-2A and 3A-3A in FIG. 1A when the side surface cover 21 is pivoted further in the arrow E direction.

First, the serviceman (including the user) detaches a screw, not shown, fastening the frame body 1 and the side surface cover 21. Then, as shown in FIGS. 1A, 4A, and 4B, the serviceman pivots the side surface cover 21 in the arrow E direction around the pivot shaft 25 as the center. Thereby, the ridgeline 26 of the projection portion 22 disposed in the side surface cover 21 abuts onto the first engagement surface 28 of the hole portion 23 of the frame body 1.

This is because a surface on a downstream side of the projection portion 22 in the arrow E direction is the facing surface 27 and the ridgeline 26 is an outer edge in a radial direction with the pivot shaft 25 as the center. Therefore, when the side surface cover 21 is pivoted in the arrow E direction, the ridgeline 26 of the projection portion 22 at first abuts onto the first engagement surface 28 of the hole portion 23 of the frame body 1.

As shown in FIGS. 3 and 4A, when viewed in the third direction D3, the ridgeline 26 is a straight line extending in the first direction D1 so as to cross the first engagement surface 28. That is, in the first direction D1, the ridgeline 26 extends so as to overlap the first engagement surface 28 and project upward and downward from the first engagement surface 28. Further, the ridgeline 26 extends upward toward the upstream in the second direction D2. In other words, the ridgeline 26 extends upward toward an inner side in the radial direction with the pivot shaft 25 as the center. Further, as shown in FIG. 3, when viewed in the third direction D3, in a region in which the first engagement surface 28 and the facing surface 27 overlap each other, an area 51 occupied by the second engagement surface 27*a* is larger than an area S2 occupied by the inclined surface 90. Thereby, it is possible to increase a fixing force of the projection portion 22 with respect to the hole portion 23.

Since the ridgeline 26 is formed as described above, when the side surface cover 21 is pivoted in the arrow E direction, the ridgeline 26 receives a force from the first engagement surface 28 downward, that is, in an arrow J direction. Thereby, the bottom portion 21*b* of the side surface cover 21 is bent downward, and also the projection portion 22 moves downward (in the arrow J direction).

When the side surface cover 21 is pivoted further in the arrow E direction, as shown in FIG. 4C, a contact point of the ridgeline 26 with the first engagement surface 28 moves toward an upper end 26*b* of the ridgeline 26. Then, when the engagement between the ridgeline 26 and the first engagement surface 28 is released, the projection portion 22 comes out from the hole portion 23, and it becomes possible to detach the side surface cover 21 from the frame body 1.

As described above, in this embodiment, it is possible to release the engagement between the projection portion 22 and the hole portion 23 by pivoting the side surface cover 21 in the arrow E direction around the pivot shaft 25 as the center. At this time, since, for example, as shown in FIG. 4C, it is not necessary for the serviceman to access an edge portion 21*c* of the bottom portion 21*b* of the side surface cover 21 so as to bend the bottom portion 21*b* downward, it is possible to easily detach the side surface cover 21. Therefore, it is possible to improve the workability at the time of detaching the side surface cover 21.

Further, even if the user applies the force to the side surface cover 21 in the third direction D3 by grasping the handle 13, the first engagement surface 28 of the hole portion 23 and the second engagement surface 27*a* of the projection portion 22 abut onto each other. Since the first and second engagement surfaces 28 and 27*a* are surfaces parallel to each other, even if these abut onto each other, the projection portion 22 does not move downward (in the arrow J direction). Therefore, it is possible to reduce the accidental detachment of the side surface cover 21.

Figure 5A:
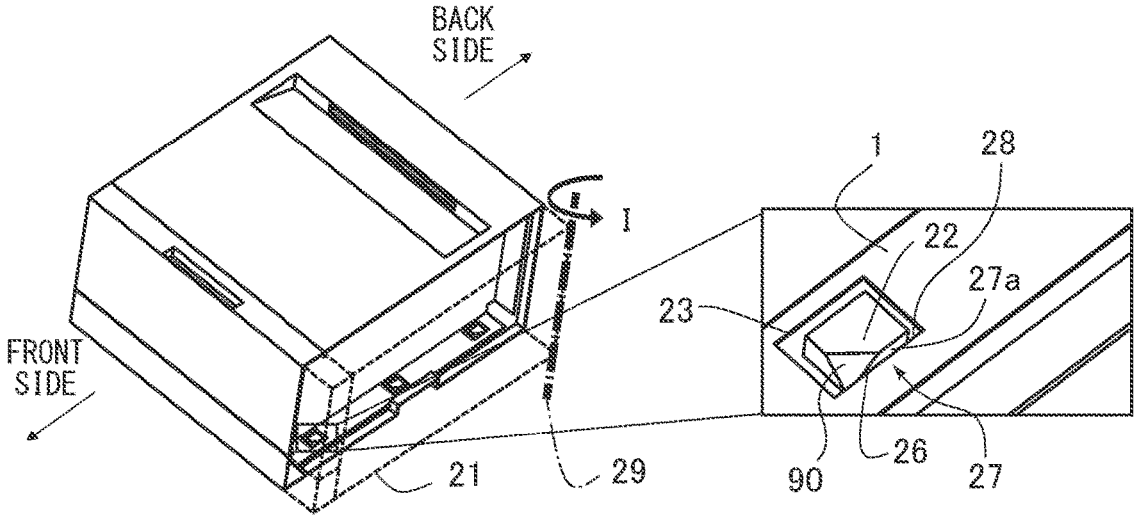
FIG. 5A is an overall schematic diagram and a partially enlarged view showing a printer relating to a first variant.

To be noted, while, in the embodiment described above, the pivot shaft 25 of the side surface cover 21 is disposed in a corner portion of a front surface of the printer 100 and one side surface, it is not limited to this. For example, as shown in FIG. 5A, it is acceptable to dispose a pivot shaft 29 of the side surface cover 21 in a corner portion of a back surface of the printer 100 and the one side surface. At this time, since the side surface cover 21 is opened from the front side, that is, the side surface cover 21 is opened in an arrow I direction around the pivot shaft 29, the inclined surface 90 disposed in the projection portion 22 of the side surface cover 21 is disposed in the corner portion on the upper and front sides of the projection portion 22. In other words, the inclined surface 90 faces the first engagement surface 28 of the hole portion 23, and is disposed in a position farther than the second engagement surface 27*a* with respect to the pivot shaft 29.

By disposing the second engagement surface 27*a* and the inclined surface 90 as described above, the ridgeline 26 formed by these second engagement surface 27*a* and inclined surface 90 extends so as to be separated from the pivot shaft 29 in the second direction D2 toward the downstream side in the first direction D1. In other words, the ridgeline 26 extends so as to be separated from the pivot shaft 29 in the second direction D2 as the ridgeline 26 extends downstream in the first direction D1. Thereby, when the side surface cover 21 is pivoted in a direction separating from the frame body 1 around the pivot shaft 29, the ridgeline 26 is sliding contact with the first engagement surface 28. Then, the projection portion 22 comes out from the hole portion 23, and it becomes possible to detach the side surface cover 21 from the frame body 1.

Figure 5B:
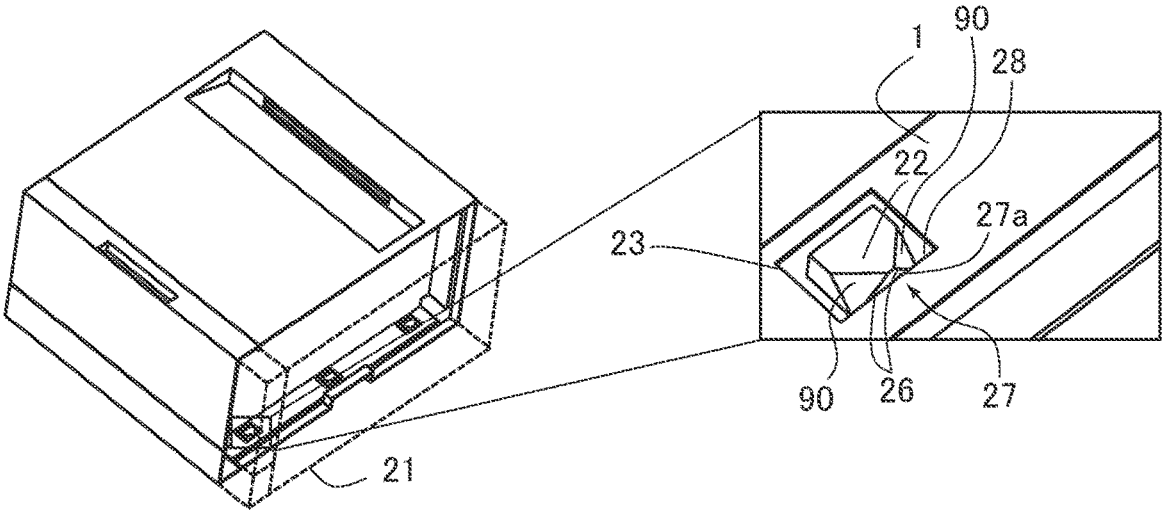
FIG. 5B is an overall schematic diagram and a partially enlarged view showing a printer relating to a second variant.

Further, if the side surface cover 21 is pivotable around both of the pivot shaft 25 shown in FIG. 1A and the pivot shaft 29 shown in FIG. 5A, it is acceptable, as shown in FIG. 5B, to dispose two inclined surfaces 90 in the facing surface 27 of the projection portion 22. In this case, two ridgelines 26 are formed in the facing surface 27.

Figure 6:
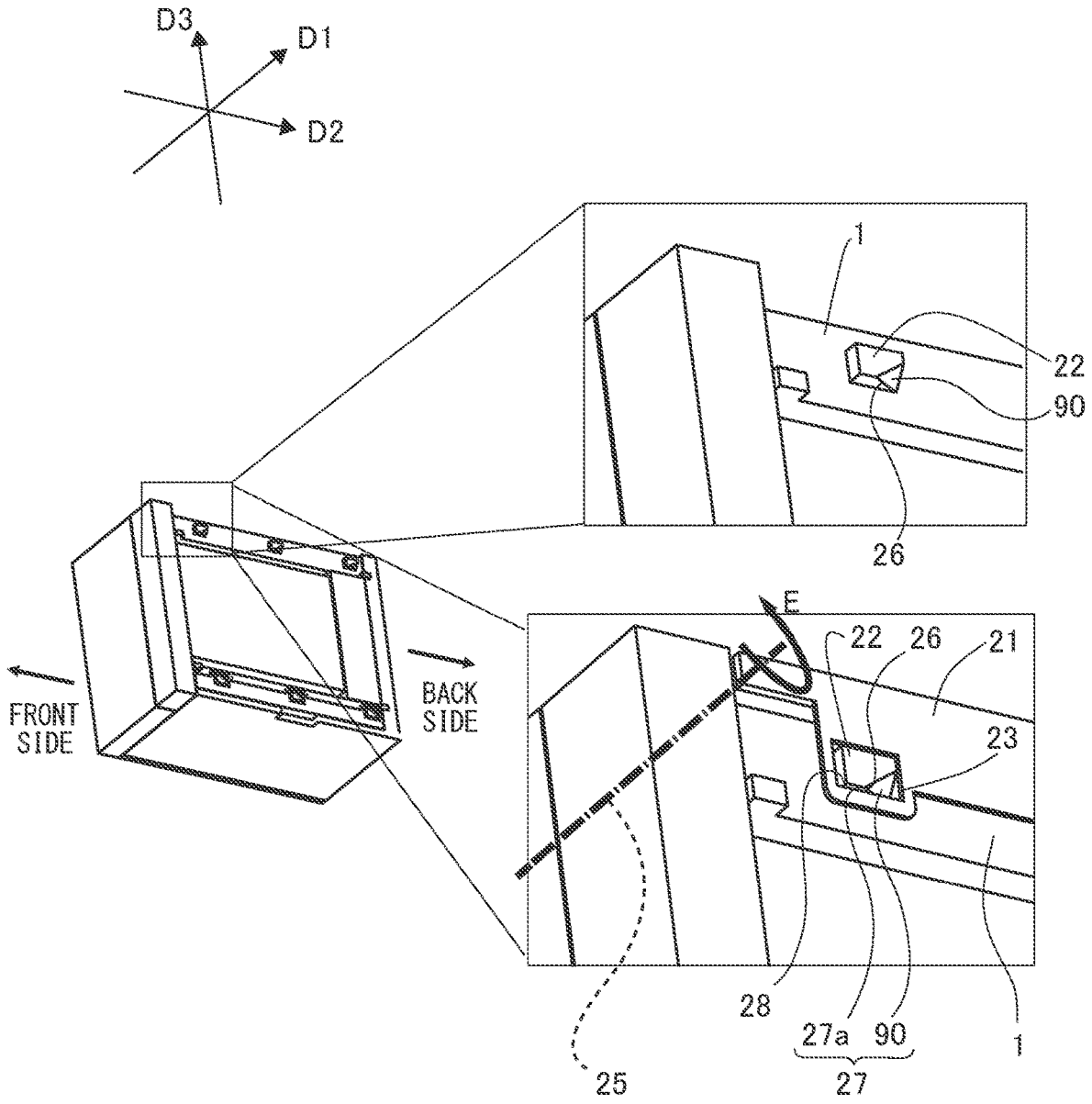
FIG. 6 is an overall schematic diagram and a partially enlarged view showing a printer relating to a third variant.

Further, while, in the embodiment described above, the hole portion 23 and the projection portion 22 are respectively disposed in the frame body 1 and the side surface cover 21, it is not limited to this. FIG. 6 is a perspective view showing a bottom surface side of a printer relating to a variant, a partially enlarged view in a state where the side surface cover is detached, and a partially enlarged view in a state where the side surface cover is attached. For example, as shown in FIG. 6, it is acceptable to dispose the projection portion 22 in the frame body 1 and dispose the hole portion 23 engaging with the projection portion 22 in the side surface cover 21. The hole portion 23 includes a first engagement surface 28. The projection portion 22 includes a first engagement surface 28 and a facing surface 27. The facing surface 27 includes a second engagement surface 27*a* and an inclined surface 90 extending so as to be inclined with respect to the second engagement surface 27*a*. A ridgeline 26 is formed on a boundary between the second engagement surface 27*a* and the inclined surface 90. Even in a case of the configuration described above, when the side surface cover 21 is pivoted in a direction receding from the frame body 1, the ridgeline 26 formed in the projection portion 22 rubs the first engagement surface 28 of the hole portion 23. Then, the projection portion 22 comes out from the hole portion 23, and it becomes possible to detach the side surface cover 21 from the frame body 1.

Now, as shown in FIG. 6, the side surface cover 21 is configured to pivot around the pivot shaft 25 in an arrow direction E. According to a configuration in FIG. 6, the ridgeline 26 and the inclined surface 90 formed on the project portion 22 are positioned differently from the configuration in FIG. 1. Specifically, the inclined surface 90 provided on the project portion 22 of the frame body 1 is disposed in a corner portion of a lower and back side of the project portion 22. In other words, the inclined surface 90 is provided further than the second engagement surface 27*a* with respect to the pivot shaft 25 in the second direction D2. Furthermore, when viewed in the third direction D3, the ridgeline 26 extends closer to the pivot shaft 25 in the second direction D2 as the ridgeline 26 extends more downstream in the first direction D1.

Each of FIGS. 12A to 12C illustrate a diagram of the frame body 1 and the side surface cover 21 viewed from a plus side toward a minus side in the second direction D2 and a diagram of the frame body 1 and the side surface cover 21 viewed from a minus side toward a plus side in the third direction D3. As shown in FIG. 12A, the project portion 22 provided on the frame body 1 is configured to engage with hole portion 23 provided on the side surface cover 21. The ridgeline 26 is formed so as to cross the hole portion 23. By such a formation of the ridgeline 26, when the side surface cover 21 is pivoted in the arrow E direction, the first engagement surface 28 of the hole portion 23 of the side surface cover 21 abuts onto the ridgeline 26 of the projection portion 22 disposed in the frame body 1, then, the side surface cover 21 receives a force from the ridgeline 26 downward, that is, in an arrow J direction. Thereby, as shown in FIG. 12B, the side surface cover 21 is bent downward. In other words, the side surface cover 21 moves downward (in the arrow J direction).

When the side surface cover 21 is pivoted further in the arrow E direction, as shown in FIG. 12C, a contact point between the ridgeline 26 and the side surface cover 21 moves toward a lower end of the ridgeline 26. Then, when the engagement between the ridgeline 26 and the side surface cover 21 is released, the hole portion 23 comes out from the project portion 22, and it becomes possible to detach the side surface cover 21 from the frame body 1.

Figure 7A:
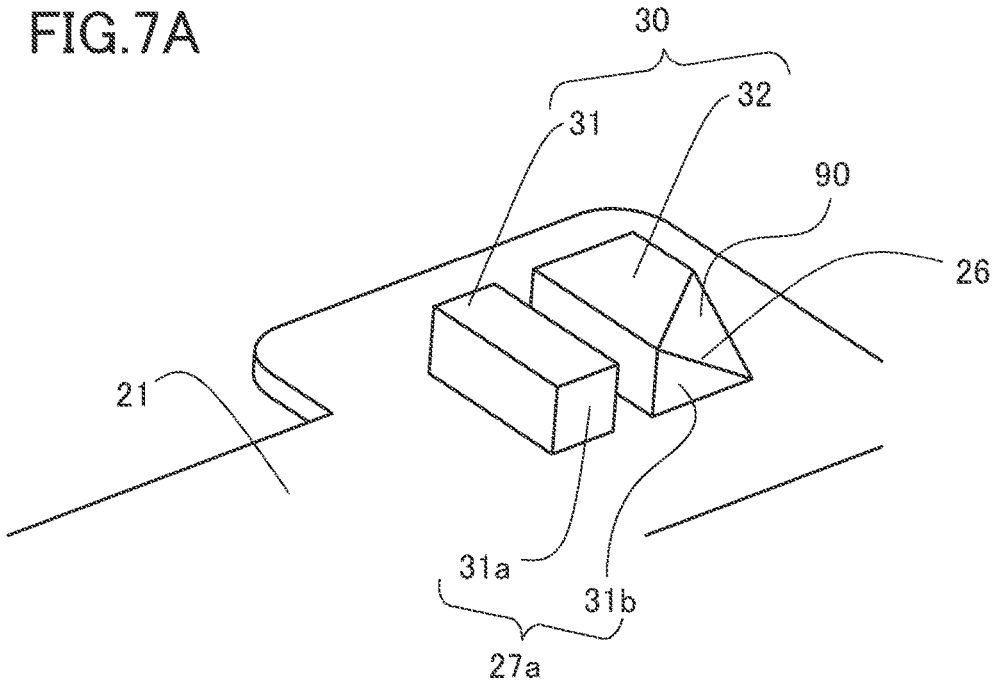
FIG. 7A is a perspective view showing a projection portion relating to a fourth variant.
Figure 7B:
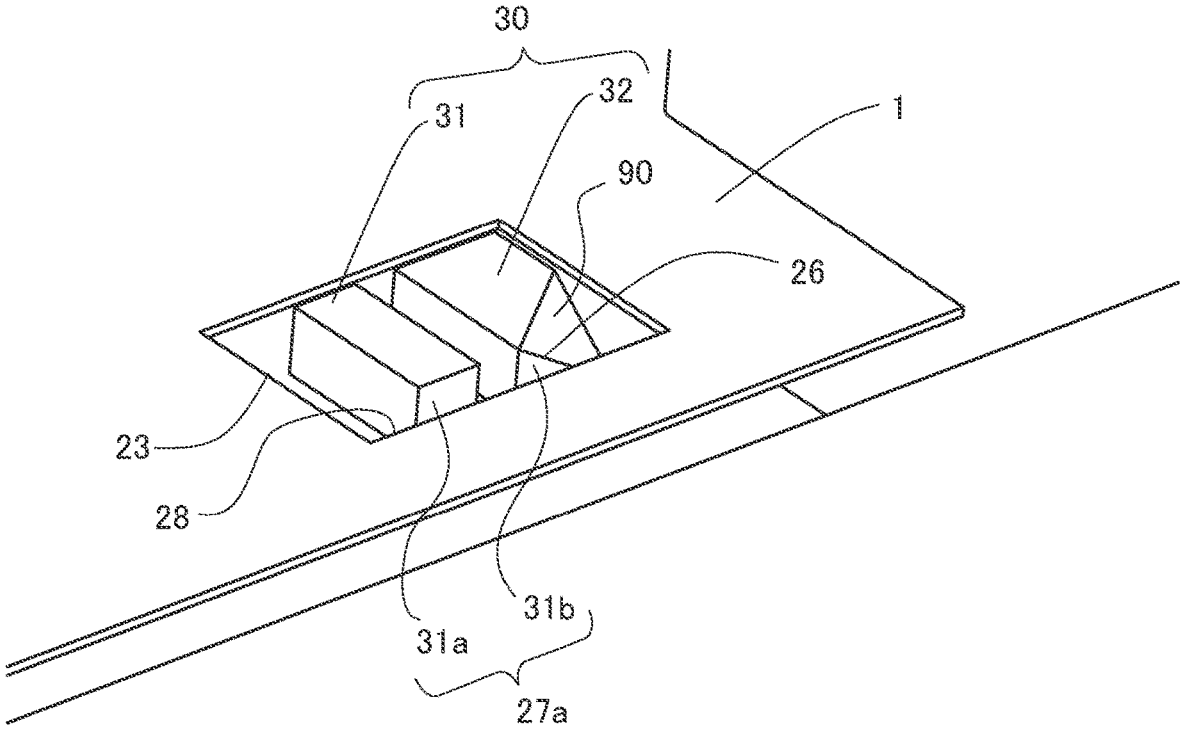
FIG. 7B is a perspective view showing the projection portion and a hole portion.

Further, while, in the embodiment described above, the one projection portion 22 includes both of the second engagement surface 27*a* and the ridgeline 26, it is not limited to this. For example, as shown in FIG. 7, it is acceptable that, by disposing a projection portion 30 in the side surface cover 21, the projection portion 30 includes a first portion 31 and a second portion 32 separated from the first portion 31. The first and second portions 31 and 32 respectively include engagement surfaces 31*a* and 32*a*, and these first and second portions 31 and 32 construct the second engagement surface 27*a* parallel to the first engagement surface 28 of the hole portion 23. The second portion 32 includes the inclined surface 90, and the ridgeline 26 is formed by an engagement surface 32*a* and the inclined surface 90. Since a function of the ridgeline 26 has been already described above, descriptions will be omitted herein.

Second Embodiment

While a second embodiment of this disclosure will be described next, in the second embodiment, this disclosure is applied to an option feeder 200 instead of the printer 100 in the first embodiment. Therefore, configurations similar to the first embodiment will be described by omitting illustrations or by putting the same reference characters on drawings herein.

Figure 8:
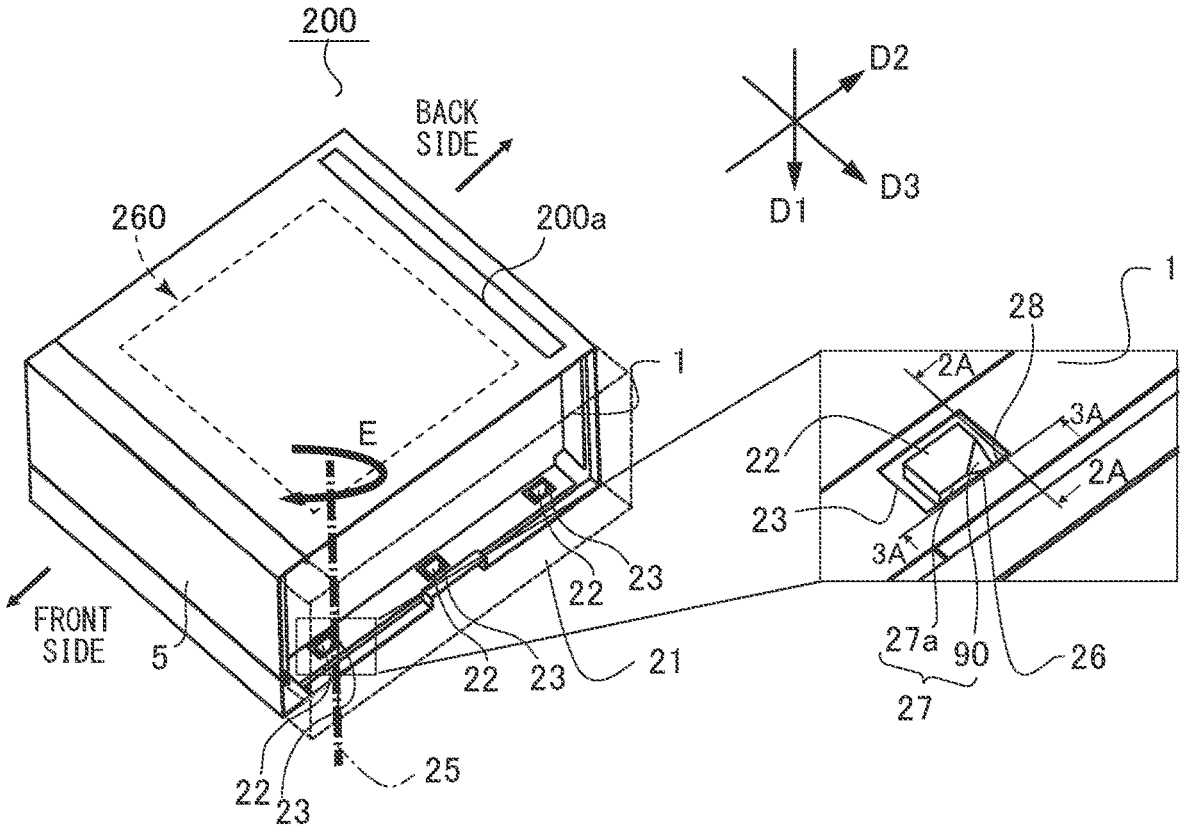
FIG. 8 is an overall schematic diagram and partially enlarged view showing an option feeder relating to a second embodiment.

As shown in FIG. 8, the option feeder 200, serving as a sheet conveyance apparatus, includes, similar to the first embodiment, the frame body 1 and the side surface cover 21. Since a method of attaching and detaching the side surface cover 21 of the option feeder 200 to and from the frame body 1 is similar to the first embodiment, descriptions will be omitted herein.

The option feeder 200 is a unit which is, for example, optionally coupled to a lower part of a printer. The option feeder 200 is detachably supported by the frame body 1, and includes a cassette 5 stacking the sheet and a conveyance unit 260 conveying the sheet stacked in the cassette 5. The conveyance unit 260 is housed in the frame body 1, and constructed by a plurality of rollers. The sheet conveyed by the conveyance unit 260 is delivered from a sheet discharge port 200*a* formed on an upper surface of the option feeder 200 to the printer coupled to an upper part of the option feeder 200.

To be noted, to this embodiment, the variants described in FIGS. 5A to 7 are, of course, applicable. For example, by disposing the projection portion 22 in the frame body 1 of the option feeder 200, it is acceptable to dispose the hole portion 23 in the side surface cover 21.

Other Embodiments

To be noted, while, in any of the embodiments described above, descriptions are provided by using the side surface cover 21 constituting the exterior of the printer 100 or the option feeder 200 on a side in the third direction D3 as an example, it is not limited to this. For example, instead of the side surface cover 21, it is acceptable to apply this disclosure to a back surface cover constituting the exterior on the back side of the printer 100 or the option feeder 200.

Further, while, in any of the embodiments described above, the ridgeline 26 is a straight line, it is not limited to this. For example, the ridgeline 26 can be a curved line.

Further, while, in any of the embodiments described above, the projection portions 22 and the hole portions 23 each are disposed three, it is not limited to this. For example, it is acceptable to dispose one to two or equal to or more than four for each of the projection portion 22 and the hole portion 23.

Further, while the first embodiment is described using the printer 100 of the electrophotographic system, this disclosure is not limited to this. For example, it is possible to apply this disclosure to an image forming apparatus of an ink jet system which forms the image on the sheet by ejecting a liquid ink through a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-126301, filed Jul. 30, 2021, which is hereby incorporated by reference herein in its entirety.

What is claimed is:

1. An apparatus comprising:

an apparatus body;

an exterior cover configured to be pivotably attached to the apparatus body, the exterior cover being configured to pivot around a pivot shaft extending in a first direction, and configured to extend in the first direction and a second direction orthogonal to the first direction;

a first engagement portion disposed in the apparatus body, the first engagement portion including a first engagement surface configured to extend in the first direction and the second direction; and a second engagement portion disposed in the exterior cover and configured to engage with the first engagement portion and release engagement with the first engagement portion by being moved in the first direction, the second engagement portion including a facing surface facing the first engagement surface in a state engaging with the first engagement portion, wherein, when viewed in a third direction orthogonal to an exterior surface of the exterior cover, the first engagement surface and the facing surface at least partially overlap each other in a state where the first engagement portion and the second engagement portion engage with each other, wherein the facing surface includes a second engagement surface and an inclined surface, the second engagement surface being configured to engage with the first engagement surface, the inclined surface being disposed farther than the second engagement surface with respect to the pivot shaft in the second direction, the inclined surface extending so as to be inclined with respect to the second engagement surface, and wherein, when viewed in the third direction, a ridgeline formed by the second engagement surface and the inclined surface extends further away from the pivot shaft in the second direction as the ridgeline extends more downstream in the first direction.

2. The apparatus according to claim 1, wherein, when viewed in the third direction, in the state where the first engagement portion and the second engagement portion engage with each other, the ridgeline is disposed so as to cross the first engagement surface in the first direction.

3. The apparatus according to claim 1, wherein the ridgeline includes a straight line.

4. The apparatus according to claim 1, wherein the ridgeline includes a curved line.

5. The apparatus according to claim 1, wherein the first engagement surface and the second engagement surface are configured to be parallel to each other in the state where the first engagement portion and the second engagement portion engage with each other.

6. The apparatus according to claim 1, wherein the second engagement portion includes a projection portion extending in the first direction, and wherein the first engagement portion includes a hole portion into which the projection portion is configured to insert.

7. The apparatus according to claim 1, further comprising an image bearing member configured to rotate and bear a toner image, wherein the first direction is a vertical direction, and wherein the third direction is a direction parallel to a rotational axis direction of the image bearing member.

8. The apparatus according to claim 1, wherein the exterior cover includes a grasping portion configured to be grasped by a user, and wherein, in the state where the first engagement portion and the second engagement portion engage with each other, the first engagement portion and the second engagement portion are disposed adjacent to the grasping portion in the third direction.

9. The apparatus according to claim 1, wherein, when viewed in the third direction, in a region in which the first engagement surface and the facing surface overlap each other, an area occupied by the second engagement surface is larger than an area occupied by the inclined surface.

10. An image forming apparatus comprising:

an apparatus body;

an exterior cover configured to be pivotably attached to the apparatus body, the exterior cover being configured to pivot around a pivot shaft extending in a first direction, and configured to extend in the first direction and a second direction orthogonal to the first direction;

a first engagement portion disposed in the exterior cover, the first engagement portion including a first engagement surface configured to extend in the first direction and the second direction; and a second engagement portion disposed in the apparatus body and configured to engage with the first engagement portion and release engagement with the first engagement portion by being moved in the first direction, the second engagement portion including a facing surface facing the first engagement surface in a state engaging with the first engagement portion, wherein, when viewed in a third direction orthogonal to an exterior surface of the exterior cover, the first engagement surface and the facing surface at least partially overlap each other in a state where the first engagement portion and the second engagement portion engage with each other, wherein the facing surface includes a second engagement surface and an inclined surface, the second engagement surface being configured to engage with the first engagement surface, the inclined surface being disposed farther than the second engagement surface with respect to the pivot shaft in the second direction, the inclined surface extending so as to be inclined with respect to the second engagement surface, and wherein, when viewed in the third direction, a ridgeline formed by the second engagement surface and the inclined surface extends closer to the pivot shaft in the second direction as the ridgeline extends more downstream in the first direction.

11. The image forming apparatus according to claim 10, wherein, when viewed in the third direction, in the state where the first engagement portion and the second engagement portion engage with each other, the ridgeline is disposed so as to cross the first engagement surface in the first direction.

12. The image forming apparatus according to claim 10, wherein the ridgeline includes a straight line.

13. The image forming apparatus according to claim 10, wherein the ridgeline includes a curved line.

14. The image forming apparatus according to claim 10, wherein the first engagement surface and the second engagement surface are configured to be parallel to each other in the state where the first engagement portion and the second engagement portion engage with each other.

15. The image forming apparatus according to claim 10, wherein the second engagement portion includes a projection portion extending in the first direction, and wherein the first engagement portion includes a hole portion into which the projection portion is configured to insert.

16. The image forming apparatus according to claim 10, further comprising an image bearing member configured to rotate and bear a toner image, wherein the first direction is a vertical direction, and wherein the third direction is a direction parallel to a rotational axis direction of the image bearing member.

17. The image forming apparatus according to claim 10, wherein the exterior cover includes a grasping portion configured to be grasped by a user, and wherein, in the state where the first engagement portion and the second engagement portion engage with each other, the first engagement portion and the second engagement portion are disposed adjacent to the grasping portion in the third direction.

18. The image forming apparatus according to claim 10, wherein, when viewed in the third direction, in a region in which the first engagement surface and the facing surface overlap each other, an area occupied by the second engagement surface is larger than an area occupied by the inclined surface.

19. An apparatus comprising:

an apparatus body;

an exterior cover configured to be pivotably attached to the apparatus body, the exterior cover being configured to pivot around a pivot shaft extending in a first direction, and configured to extend in the first direction and a second direction orthogonal to the first direction;

a first engagement portion disposed in the apparatus body, the first engagement portion including a first engagement surface configured to extend in the first direction and the second direction; and a second engagement portion disposed in the exterior cover, the second engagement portion including a facing surface facing the first engagement surface in a state where the second engagement portion engages with the first engagement portion, wherein, when viewed in a third direction orthogonal to an exterior surface of the exterior cover, the first engagement surface and the facing surface at least partially overlap each other in a state where the first engagement portion and the second engagement portion engage with each other, wherein the facing surface includes a second engagement surface and an inclined surface, the second engagement surface being configured to engage with the first engagement surface, the inclined surface being disposed farther than the second engagement surface with respect to the pivot shaft, the inclined surface extending so as to be inclined with respect to the second engagement surface, and wherein, when the exterior cover is pivoted in a direction away from the apparatus body around the pivot shaft, a ridgeline formed by the second engagement surface and the inclined surface is sliding contact with the first engagement surface, and the second engagement portion moves in the first direction so as to release engagement between the first engagement portion and the second engagement portion.

20. An image forming apparatus comprising:

an apparatus body;

an exterior cover configured to be pivotably attached to the apparatus body, the exterior cover being configured to pivot around a pivot shaft extending in a first direction, and configured to extend in the first direction and a second direction orthogonal to the first direction;

a first engagement portion disposed in the exterior cover, the first engagement portion including a first engagement surface configured to extend in the first direction and the second direction; and a second engagement portion disposed in the apparatus body, and including a facing surface facing the first engagement surface in a state engaging with the first engagement portion, wherein, when viewed in a third direction orthogonal to an exterior surface of the exterior cover, the first engagement surface and the facing surface at least partially overlap each other in a state where the first engagement portion and the second engagement portion engage with each other, wherein the facing surface includes a second engagement surface and an inclined surface, the second engagement surface being configured to engage with the first engagement surface, the inclined surface being disposed farther than the second engagement surface with respect to the pivot shaft, the inclined surface extending so as to be inclined with respect to the second engagement surface, and wherein, when the exterior cover is pivoted in a direction away from the apparatus body around the pivot shaft, a ridgeline formed by the second engagement surface and the inclined surface is sliding contact with the first engagement surface, and the second engagement portion moves in the first direction so as to release engagement between the first engagement portion and the second engagement portion.

* * * * *